US008246524B2

(12) United States Patent
Castillo

(10) Patent No.: US 8,246,524 B2
(45) Date of Patent: Aug. 21, 2012

(54) EXERCISE DEVICE

(76) Inventor: Ivonne Castillo, Fuquay-Varina, NC (US)

( * ) Notice: Subject to any disclaimer, the term of this patent is extended or adjusted under 35 U.S.C. 154(b) by 317 days.

(21) Appl. No.: 12/661,376

(22) Filed: Mar. 16, 2010

(65) Prior Publication Data

US 2011/0230315 A1 Sep. 22, 2011

(51) Int. Cl.
*A63B 23/02* (2006.01)
*A63B 21/06* (2006.01)

(52) U.S. Cl. ..... 482/92; 482/40; 482/101; 482/132; 482/135; 482/139; 482/904; 482/907

(58) Field of Classification Search ..... 482/20, 482/37–40, 44, 49, 50, 78, 92–96, 98, 101–103, 482/131, 132, 135, 139, 143, 904, 907; 473/451; 434/258; 602/34; 606/237, 241; 5/646, 5/647

See application file for complete search history.

(56) References Cited

U.S. PATENT DOCUMENTS

| | | | | | |
|---|---|---|---|---|---|
| 798,114 | A | * | 8/1905 | Rosenthal | 482/130 |
| 2,953,394 | A | * | 9/1960 | Anderson | 280/207 |
| 4,149,713 | A | | 4/1979 | McLeod | |
| 4,627,588 | A | * | 12/1986 | Block | 248/163.2 |
| 4,640,268 | A | | 2/1987 | Roberts | |
| 4,842,270 | A | * | 6/1989 | Lange | 482/101 |
| 4,921,245 | A | | 5/1990 | Roberts | |
| 5,102,122 | A | | 4/1992 | Piane, Jr. et al. | |
| 5,151,070 | A | * | 9/1992 | Norman | 482/99 |
| 5,197,933 | A | | 3/1993 | Waters | |
| 5,241,952 | A | * | 9/1993 | Ortiz | 601/40 |
| 5,441,255 | A | | 8/1995 | Verbick | |
| 5,643,162 | A | * | 7/1997 | Landers et al. | 482/131 |
| 5,904,099 | A | * | 5/1999 | Danneker | 104/53 |
| 5,928,054 | A | * | 7/1999 | Mast | 446/227 |
| 6,102,836 | A | * | 8/2000 | Person | 482/103 |
| 6,165,110 | A | | 12/2000 | Gajda | |
| 6,217,483 | B1 | * | 4/2001 | Kallassy | 482/38 |
| 6,413,198 | B1 | * | 7/2002 | Gray | 482/148 |
| 6,685,600 | B1 | | 2/2004 | Ullman | |
| 6,863,642 | B2 | * | 3/2005 | Lamont | 482/123 |
| 7,056,224 | B1 | | 6/2006 | Keyes | |
| 7,056,269 | B2 | * | 6/2006 | Cleveland et al. | 482/148 |
| 7,063,651 | B2 | | 6/2006 | Kerry | |
| 7,104,926 | B2 | * | 9/2006 | Carlson | 482/10 |

(Continued)

FOREIGN PATENT DOCUMENTS

DE 3731552 A1 * 4/1989

(Continued)

*Primary Examiner* — Loan Thanh
*Assistant Examiner* — Victor K Hwang
(74) *Attorney, Agent, or Firm* — Miller Patent Services; Jerry A. Miller

(57) ABSTRACT

An exercise device with an arc shaped track having a concave side that is mounted upon a support structure that supports the arc shaped track at a position in which the concave side of the arc faces downward and in which the arc shaped track can be fixed at a location centered above a user's head to extend to each side of the user. When in use, a track follower engages the track and moves along a length of the track to follow a course defined by the arc shape of the track. A handle is coupled to the track follower to be gripped by the user's hand to guide the user's side to side bends. This abstract is not to be considered limiting, since other embodiments may deviate from the features described in this abstract.

34 Claims, 12 Drawing Sheets

U.S. PATENT DOCUMENTS

| | | | | |
|---|---|---|---|---|
| 7,118,514 | B2 * | 10/2006 | Underbrink et al. | 482/35 |
| 7,121,989 | B2 | 10/2006 | Kerry | |
| 7,303,515 | B2 | 12/2007 | Wall | |
| 7,335,141 | B2 | 2/2008 | Piane, Jr. | |
| 8,021,240 | B2 * | 9/2011 | King et al. | 472/136 |
| 8,066,621 | B2 * | 11/2011 | Carlson | 482/8 |
| 2003/0027694 | A1 | 2/2003 | Harrison | |
| 2004/0033869 | A1 | 2/2004 | Carlson | |
| 2004/0214696 | A1 | 10/2004 | Kerry | |
| 2005/0272570 | A1 | 12/2005 | Gustafson | |
| 2006/0100072 | A1 | 5/2006 | Kerry | |
| 2007/0161475 | A1 | 7/2007 | Kerry | |
| 2008/0261784 | A1 | 10/2008 | Osbak | |

FOREIGN PATENT DOCUMENTS

| | | |
|---|---|---|
| FR | 2 674 136 | 3/1991 |

* cited by examiner

EXERCISE DEVICE

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

There are many exercise devices that are useful for assisting a user in carrying out various types of exercises. Among the more difficult muscles to tone by exercise are the abdominal oblique muscles. A number of exercises are useful in toning the abdominal oblique muscles including side bending exercises.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
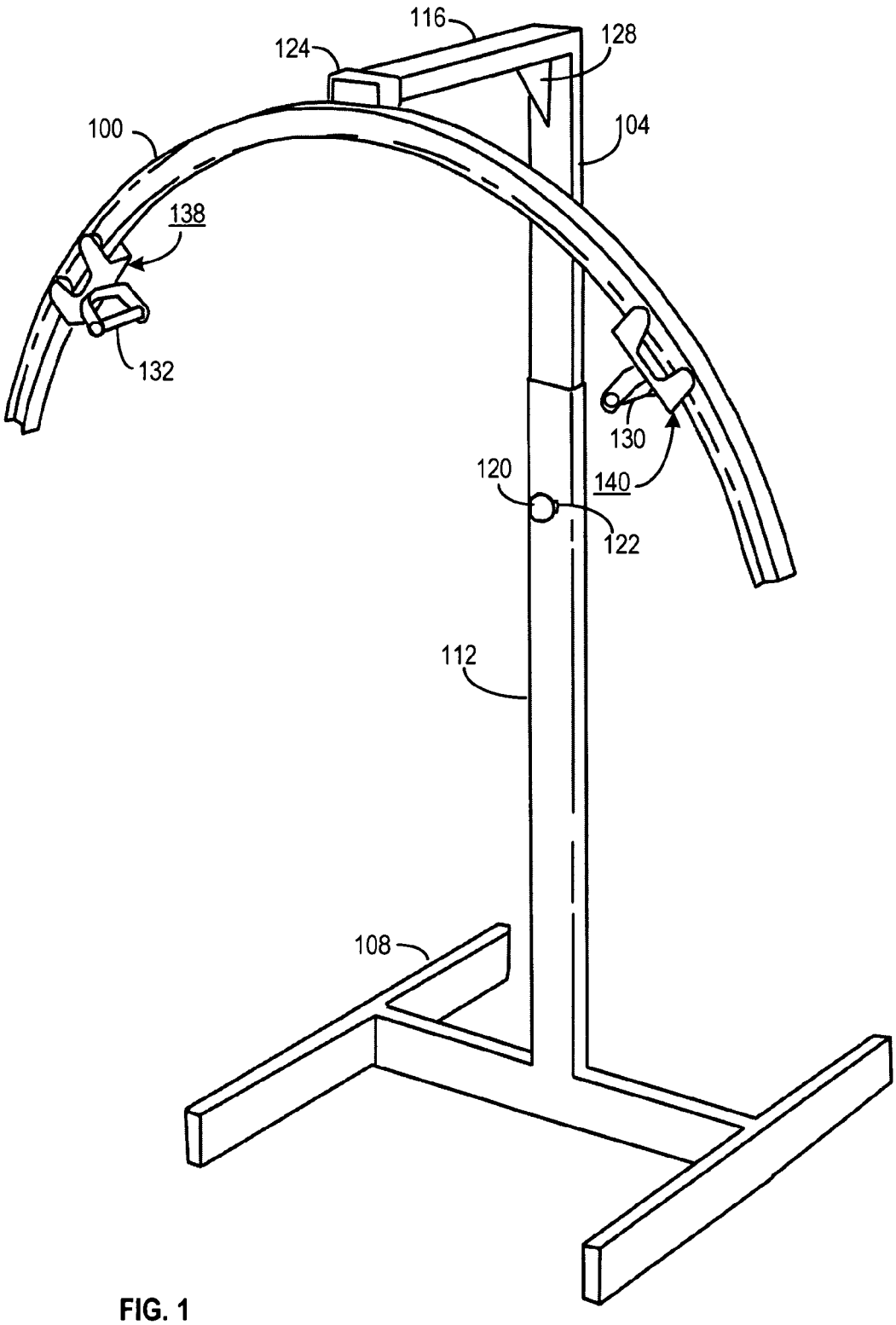
FIG. 1 is an example of the exercise device attached to a floor mount with adjustable height consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. Reference throughout this document to "one embodiment", "certain embodiments", "an embodiment", "an example", "an implementation" or similar terms means that a particular feature, structure, or characteristic described in connection with the embodiment, example or implementation is included in at least one embodiment, example or implementation of the present invention. Thus, the appearances of such phrases or in various places throughout this specification are not necessarily all referring to the same embodiment, example or implementation. Furthermore, the particular features, structures, or characteristics may be combined in any suitable manner in one or more embodiments, examples or implementations without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Exercise devices that facilitate exercise motions above the head of the user typically provide for a vertical movement to raise and lower weight, exercising those muscle groups used in lifting burdens in a vertical straight line almost exclusively. Abdominal oblique muscles, as previously noted, are difficult to effectively exercise. Implementations consistent with embodiments of the present invention provide for a controlled mechanism for doing side bending exercises that can assist in properly conditioning the abdominal oblique muscles. Therefore, embodiments of the exercise device as described can be used for working the internal abdominal oblique muscles to stabilize the spine in instances where this device would or could be used in physical therapy. It is also said that when these muscles contract they help brace the ribs, pelvis and lower back. It is easy to see why it is an important core muscle.

Turning now to FIG. 1, this figure presents an exemplary view of an illustrative exercise device having an arc track 100 attached to a floor mount 104 that is vertically adjustable to modify the height of the exercise arc 100 in relation to the floor. The open or concave side of the track 100 is oriented so as to face downward toward the floor. The arc should be at a diameter suitable for providing the user with an adequate arm extension when exercising as will be described and the open ends of the arc should extend far enough down to effectively facilitate the side bending exercises. One should be able to bend more and more as one's fitness level increase or obliques get stronger, in order to safely do the bending on each side. The arc of travel during exercise should generally not extend downward below the waist line (about 180 degrees of a circle, but this should not be considered limiting.

The illustrative floor mount 104 in this view is made up of an H-shaped base section 108 that forms a stable platform for the floor mount 104 by dispersing the weight of the exercise arc track 100, the floor mount 104 apparatus, and any weight contributed by the user during use over a broad area. Other base arrangements are also possible. A rectangular, square (or other cross-section) tube member 112 extends vertically from the H-shaped base 108 and provides the mount into which an L-shaped rectangular or square cross-section tube 116 of slightly smaller exterior dimension than the interior dimension of the vertical member 112 may be inserted. (In other examples, the larger and smaller exterior dimensions can be reversed. The L-shaped square tube 116 may be raised and lowered after being inserted within the vertical member 112 to adjust the height of the L-shaped square tube 116. The L-shaped square tube 116 vertical positioning is secured by a screw, bolt, pin or other latch 120 that extends from the L-shaped square tube 116, through an opening in the vertical member 122, and prevents the L-shaped square tube 116 from descending too far down into the vertical member 112.

At the distal end of the L-shaped square tube 116 a mounting bracket 124 or other attachment mechanism provides a removable attachment point for the exercise arc track 100. A stability flange 128 with for example with a triangular shape or other bracing member may be attached to the inside bend of the L-shaped square tube 116 to provide additional strength against bending moments that occur at the distal end of the L-shaped square tube 116 when the exercise apparatus is in use. Two handles having handle grips 130 and 132 are configured to attach to track followers 138 and 140 as shown to slide, glide or roll along the length of the exercise arc track 100. The handles may be removably attached to the exercise arc track 100 for use by an individual during exercise activities. The term "handles" as used herein, generally means the handle grips 130 and 132 along with the track followers 140 and 138 and any attached structures as will be described by way of example later.

Figure 2:
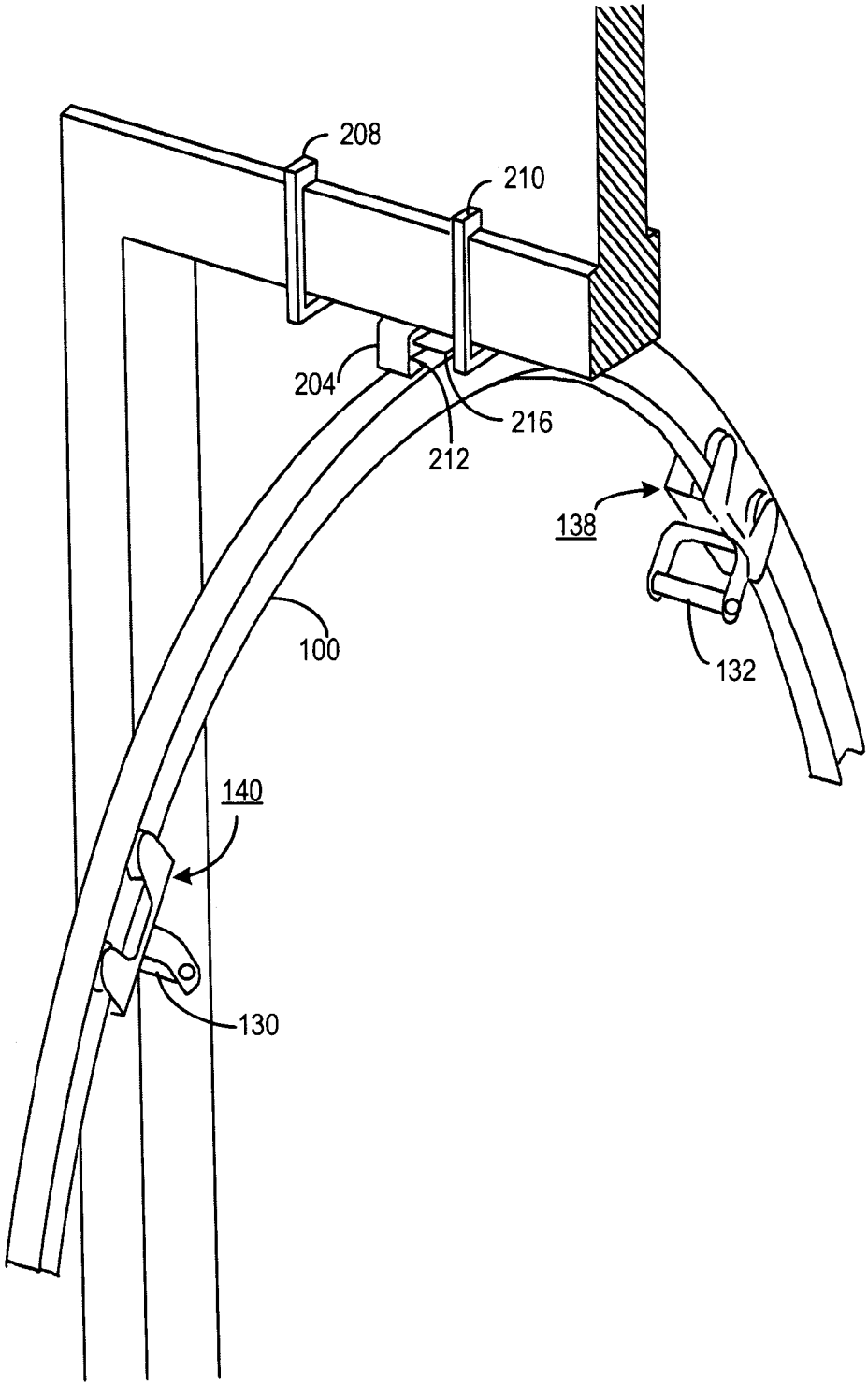
FIG. 2 is an example of the exercise device mounted to a door frame consistent with certain embodiments of the present invention.

Turning now to FIG. 2, this figure presents an exemplary view of an illustrative exercise arc track 100 attached to a doorway through the use of a doorway mount 204. The doorway mount 204 may be made up of two or more bracket arms 208 and 210 that are substantially C-shaped and are removably attached to the top of any convenient doorway, for example by a clamping action or by virtue of being attached by screws or bolts. A lateral cross member (not shown) connects the two bracket arms 208 and 210 together and provides an attachment mount 212 for the exercise arc track 100. Secured to the top center section of the exercise arc track 100 is a mounting flange 216 that is of sufficient size and shape to be inserted into the attachment mount 212 to secure the exercise arc track 100 to the doorway mount 204 for use in exercise activities. In one implementation, the attachment mount 212 may provide one or more attachment slots into which the mounting flange 216 on top of the exercise arc track 100 may be inserted, thereby providing some vertical height adjustment capability.

When secured to the doorway mount 204, the exercise arc track 100 extends to either side of the doorway normal to a plane of the doorway opening and doorway frame with the concave side of the arc facing downward in order to permit the person using the exercise device to bend side to side in a manner unencumbered by the door frame in order to exercise the abdominal oblique muscles. Two handles 130 and 132 are configured to attach to the track followers 140 and 138 respectively to slide along the length of the exercise arc 100. The track followers and handles may be removably attached to the exercise arc track 100 for use by an individual during exercise activities. In other embodiments, not shown, a mechanism can be provided for raising or lowering the arc to individualize the height of the arc with respect to the exerciser. Other variations will occur to those skilled in the art upon consideration of the present teachings.

Figure 3:
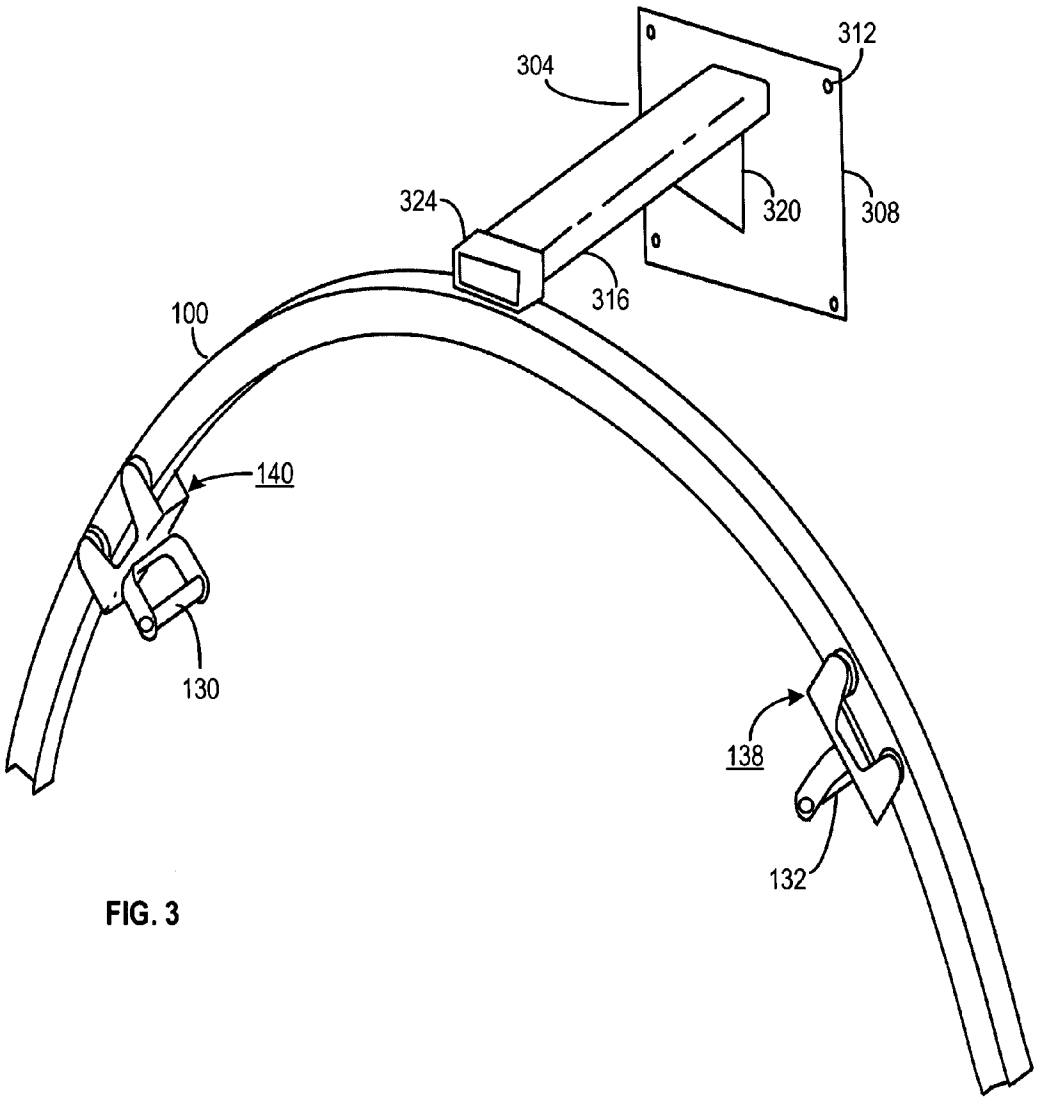
FIG. 3 is an example of the exercise device attached to a wall mount consistent with certain embodiments of the present invention.

Turning now to FIG. 3, this figure presents an exemplary view of an illustrative exercise device including an exercise arc track 100 attached to a wall through the use of a wall mount 304. The wall mount 304 in this illustrative example is made up of a flat wall plate 308 that may be secured to a substantially flat wall area through the use of one or more anchor bolts 312 or any other suitable fastener that may be used to so secure a flat wall plate 308 to a wall surface. A horizontal arm 316 extends at a 90 degree angle (in this example) from the surface of the flat wall plate 308. A stability flange 320 (or other reinforcing structure) with a triangular shape is attached to the inside of the attachment point of the horizontal arm 316 to the flat wall plate 308 to provide additional strength against bending moments that occur at the distal end of the horizontal arm 316.

A mounting bracket 324 which may have the same cross sectional shape as the horizontal arm 316 is affixed to the top center point of the exercise arc track 100. The mounting bracket 324 has an opening of sufficient interior size to enable the mounting bracket 324 to be attached to the horizontal arm 316 by sliding the mounting bracket 324 onto the horizontal arm 316 and then secured in place by any suitable mechanism. Once affixed, the mounting bracket 324 is positioned so as to hold the exercise arc track 100 in a position perpendicular to a plane of the horizontal arm 316 of the wall mount 304. The exercise arc track 100 when attached to the wall mount 304 may have one or more exercise handles (130, 132) installed in any suitable manner so as to move freely along the exercise arc track 100 to provide grips for an individual using the exercise arc track 100 for exercise or therapeutic motion activity (where the term "freely" is not intended to suggest that there is no resistance to the movement, since weights, springs or other devices can be implemented to provide resistance as will be seen later). By bending side to side while allowing the handles to follow the exercise arc track, the user can effectively exercise the abdominal oblique muscles. In other embodiments, not shown, a mechanism can be provided for raising or lowering the arc to individualize the height of the arc with respect to the exerciser.

Figure 4:
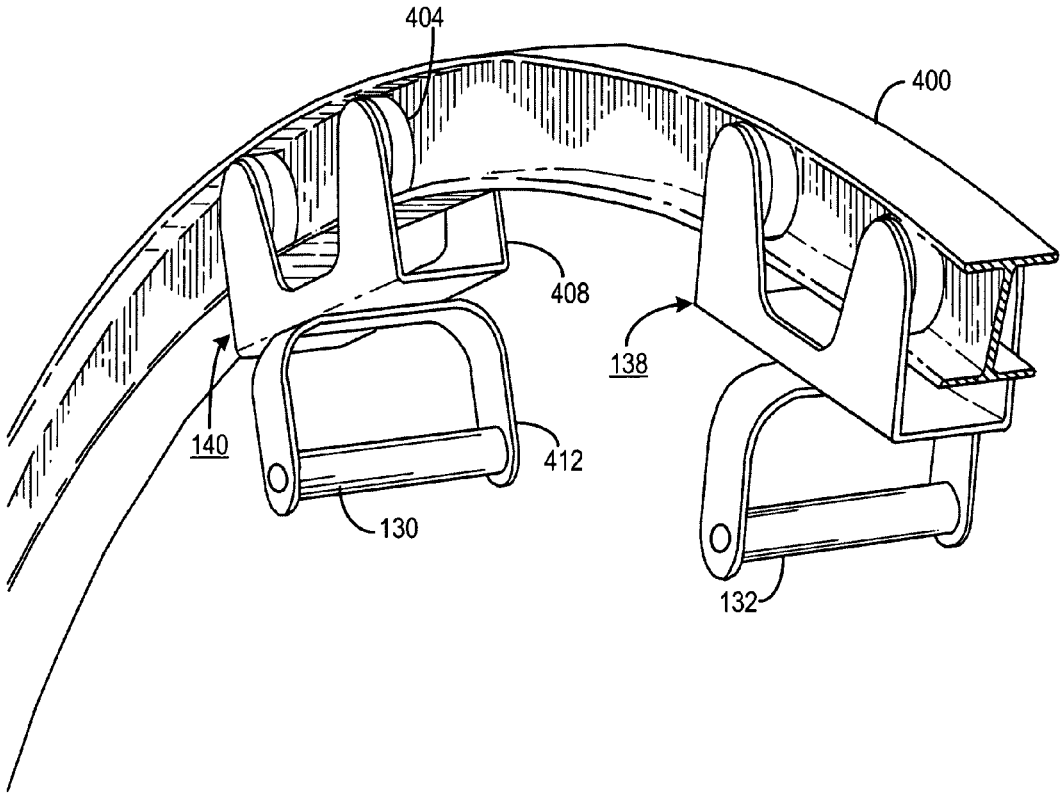
FIG. 4 is an example of the arc-shaped track of the exercise device with an I-shaped cross section consistent with certain embodiments of the present invention.

Turning now to FIG. 4, this figure presents an exemplary view of an illustrative exercise arc track with an I-shaped cross section 400. The I-shaped exercise arc track 400 provides two opposing channels (within the sides of the "I") for the placement of track followers 140 and 138 for attachment of one or more exercise handle grips 130 and 132 for use in exercise or therapeutic motion activity. Each exercise handle grip 132 and 130 is respectively connected to a track follower 138 and 140 each having one or more wheels 404 of sufficient diameter to fit and move within the channels of the I-shaped exercise arc track 400, a wheel mounting bracket 408 secures the wheels in place and to the handle grip bracket 412 affixed to the wheel mounting bracket 408 which together with the grip 130 or 132 forms the handle assembly. Thus, the track followers 138 or 140 include the wheels 404, the wheel mounting bracket 408 and any structure used to attach the exercise handles thereto. The combination of track followers 138 and 140 (along with their supporting structures) and exercise handle grips 132 and 130 may be loosely referred to herein as the exercise handles or simply handles.

The track follower(s) 140 and 138 with the attached exercise handle gripss 130 and 132 may be inserted into the channels of the I-shaped exercise arc track 400 and either connected together in an exemplary embodiment for the combined use of the exercise handles or may remain uncoupled (either directly, or by coupling of the track followers 138 and 140) so as to move independently along the track to allow for greater freedom and range of motion when in use.

Figure 5:
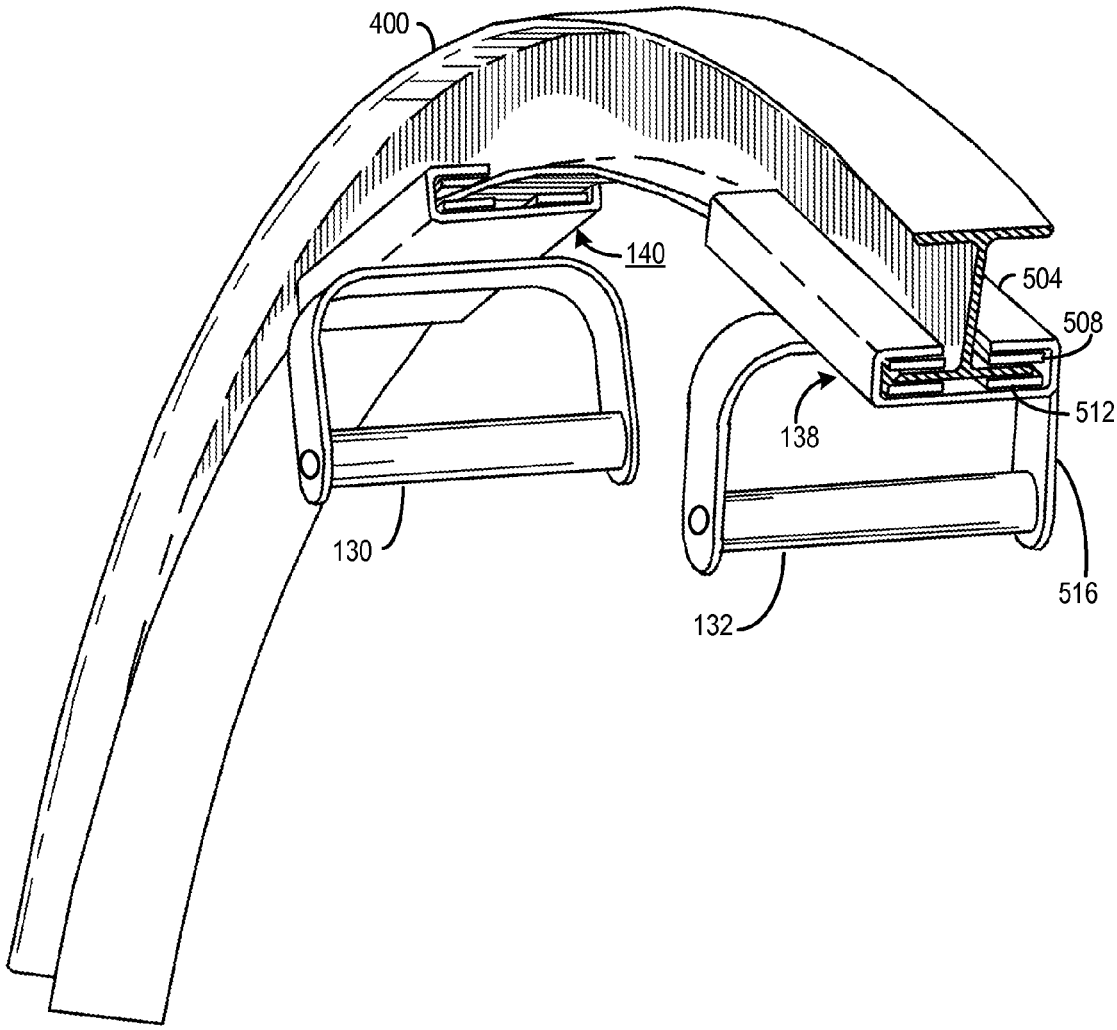
FIG. 5 is an example of the arc-shaped track of the exercise device with an I-shaped cross section and floats consistent with certain embodiments of the present invention.

Turning now to FIG. 5, this figure presents an exemplary view of an exercise arc track with an I-shaped cross section 400. The I-shaped exercise arc track 400 provides two channels for the insertion of one or more exercise handles and associated track follower(s) for use in exercise or therapeutic motion activity. Each exercise handle is connected to a track follower 140 and 138 that is made up of a substantially C-shaped mounting bracket 504 to fit over and move along the interior surface of the channels of the I-shaped exercise arc track 400, and glide surfaces 508 and 512 that are affixed to the interior of each side of the C-shaped mounting bracket 504 in such a manner as to glide along the bottom exterior branches of the I shaped exercise track 400. A handle grip 130 and 132 is affixed to the C-shaped mounting bracket 504 by structure 516 in order to couple the handle grips 130 and 132 to the track followers 140 and 138. The track followers 140 and 138 for exercise handles 130 and 132 may be inserted into the channels of the I-shaped exercise arc track 400 and either connected together (again either directly or indirectly) in an exemplary embodiment for the combined use of the exercise handles or may remain uncoupled so as to move independently along the track to allow for greater freedom and range of motion when in use.

Figure 6:
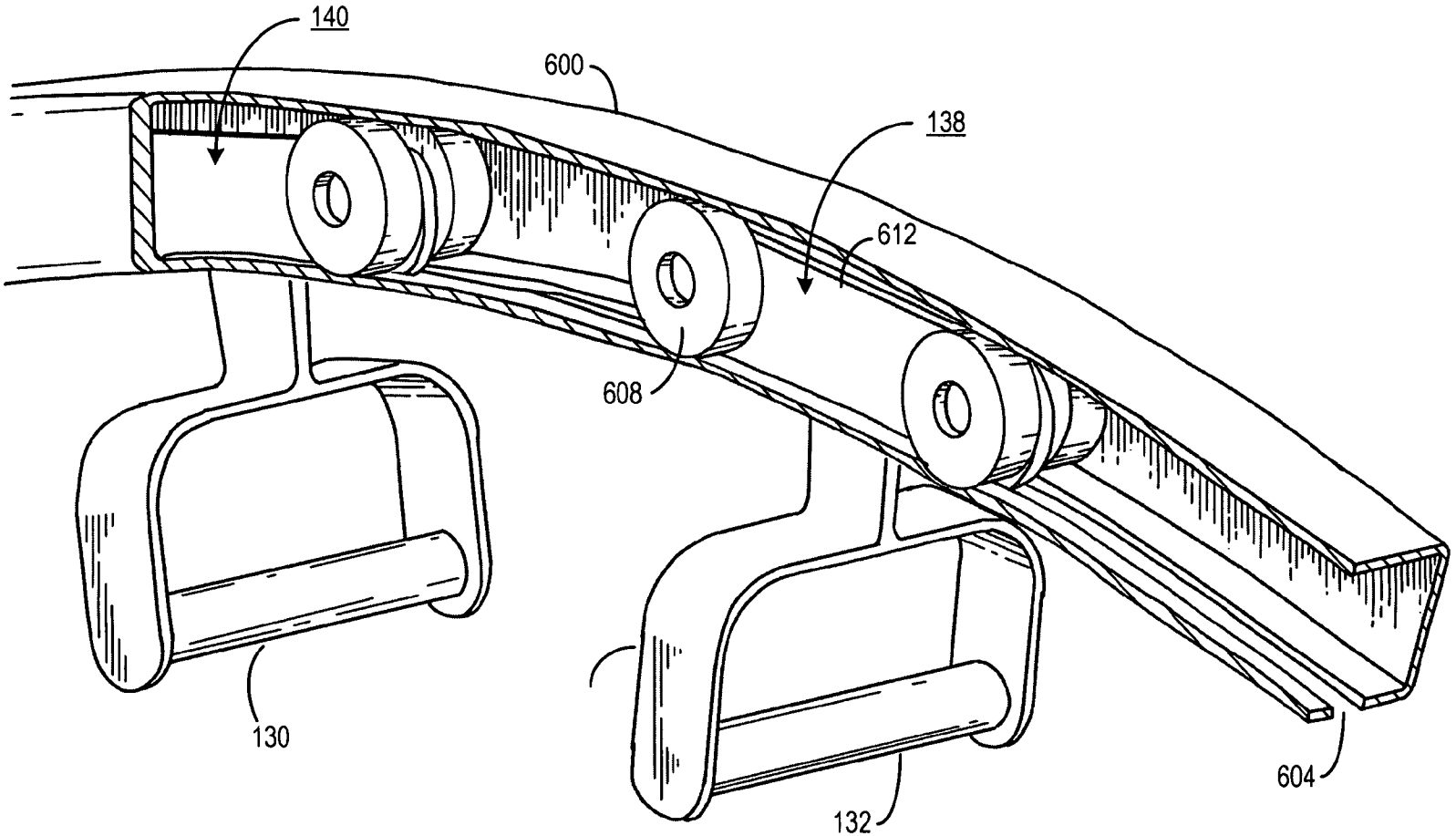
FIG. 6 is an example of the arc-shaped track of the exercise device with a C-shaped cross section consistent with certain embodiments of the present invention.

Turning now to FIG. 6, this figure presents an exemplary view of an exercise arc track with a C-shaped cross section 600. The C-shaped cross section of the exercise arc track 600 is oriented such that the opening of the C channel forms an open channel 604 in the bottom surface of the exercise arc track 600 so as to face downward in use. The C-shaped exercise arc track 600 provides the open channel 604 for the insertion of one or more track followers 140 and 138 for exercise handle grips 130 and 132 for use in exercise or therapeutic motion activity wherein the followers 140 and 138 move along the interior of the exercise arc track 600. Each track follower 140 and 138 is made up of wheels 608 of suitable diameter to fit and move within the channels of the C-shaped exercise arc track 600, a wheel mounting bracket 612 is used for securing the wheels in place using any suitable structure for affixing handle grips 130 and 132 to the wheel mounting bracket 612. The track followers 140 and 138 for each exercise handle may be inserted into the channels of the C-shaped exercise arc track 600 and can either be connected together in an exemplary embodiment for the combined use of two exercise handles or may remain uncoupled so as to move independently along the track to allow for greater freedom and range of motion when in use.

Figure 7:
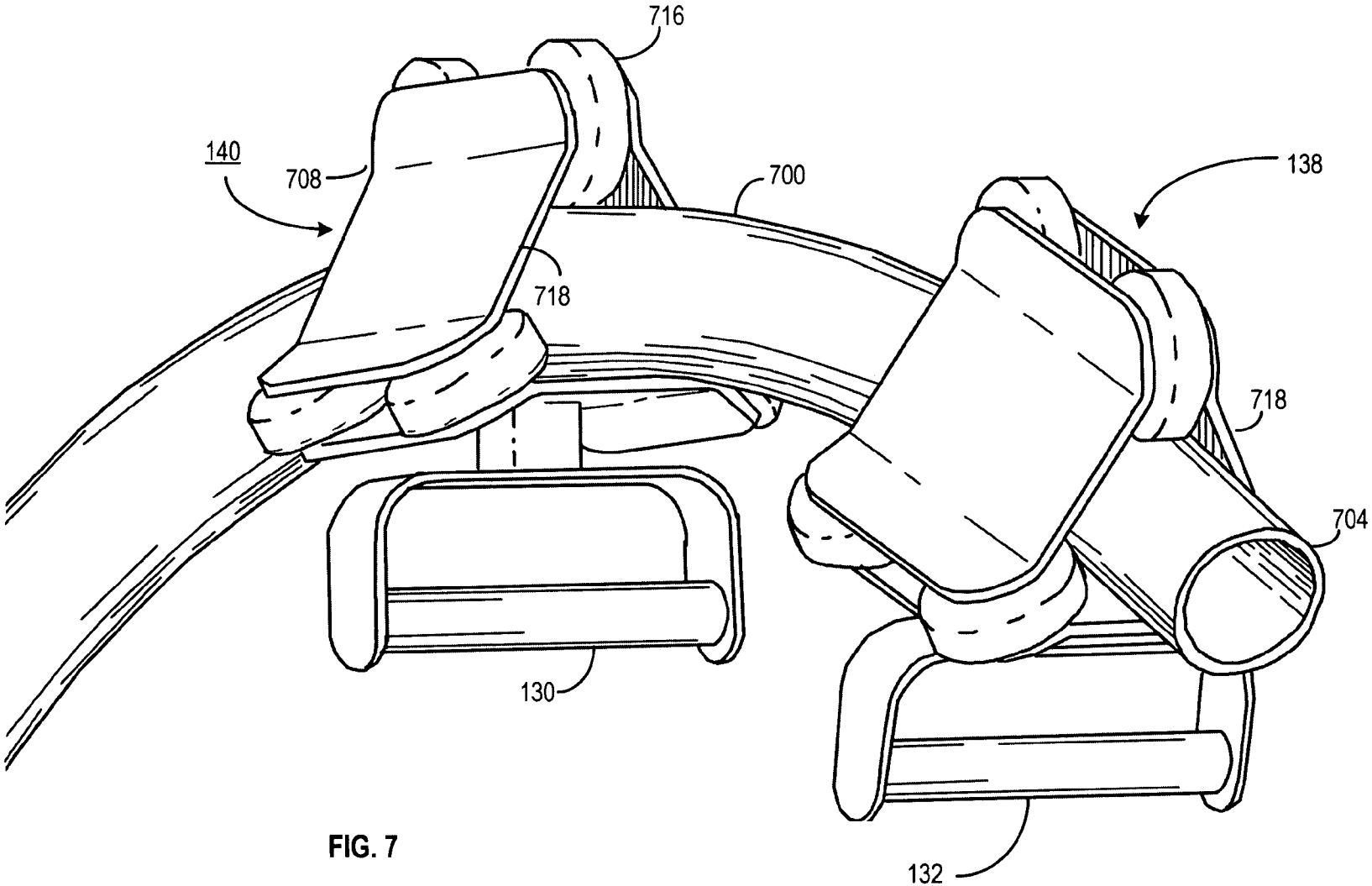
FIG. 7 is an example of the arc-shaped track of the exercise device with a circular cross section consistent with certain embodiments of the present invention.

Turning now to FIG. 7, this figure presents an exemplary view of another implementation of an exercise device including an exercise arc track with a circular cross section 700 forming a tube shaped exercise arc track 700. The exercise arc track 700 is oriented such that the center portion of the arc is the highest part of the arc with the tube descending downward to end points 704 each end point of which is below (with respect to ground) the height of the center portion of the arc and each of which is capped with an end cap (not shown). The exercise apparatus includes one or more exercise handle grips 130 and 132 which, by way of example, are configured to travel along the exterior of the exercise arc track 700. Each exercise handle grip 130 and 132 may be again attached to a track follower 140 and 138 each of which, in this example, is made up of three (or more) sets of travel wheels 716 connected together by three bracket plates 718 configured in a triangular orientation such that the three sets of wheels 716 are in contact with the exterior of the exercise arc track 700 such that the exercise handle grips, are guided by the track followers 140 and 138 so as to follow the track and travel along the exterior of the exercise arc track. The handle grips 130 and 132 are connected to the bracket plate 718 that forms the base of the triangular shaped portion of the track followers 140 and 138 and is oriented such that the handle grips can descend below the exercise arc track 700. The track followers 140 and 138 for the exercise handle grips 130 and 132 may be inserted onto the tube shaped exercise arc track 700 and either connected together in an exemplary embodiment for the combined use of the exercise handles or may remain uncoupled so as to move independently along the track to allow for greater freedom and range of motion when in use.

While in the examples presented above each handle uses its own track follower, in other implementations, a single track follower may be utilized to attach either a single handle or multiple handles without limitation. In this case, if multiple handles are used, they are coupled together by the single track follower.

Figure 8:
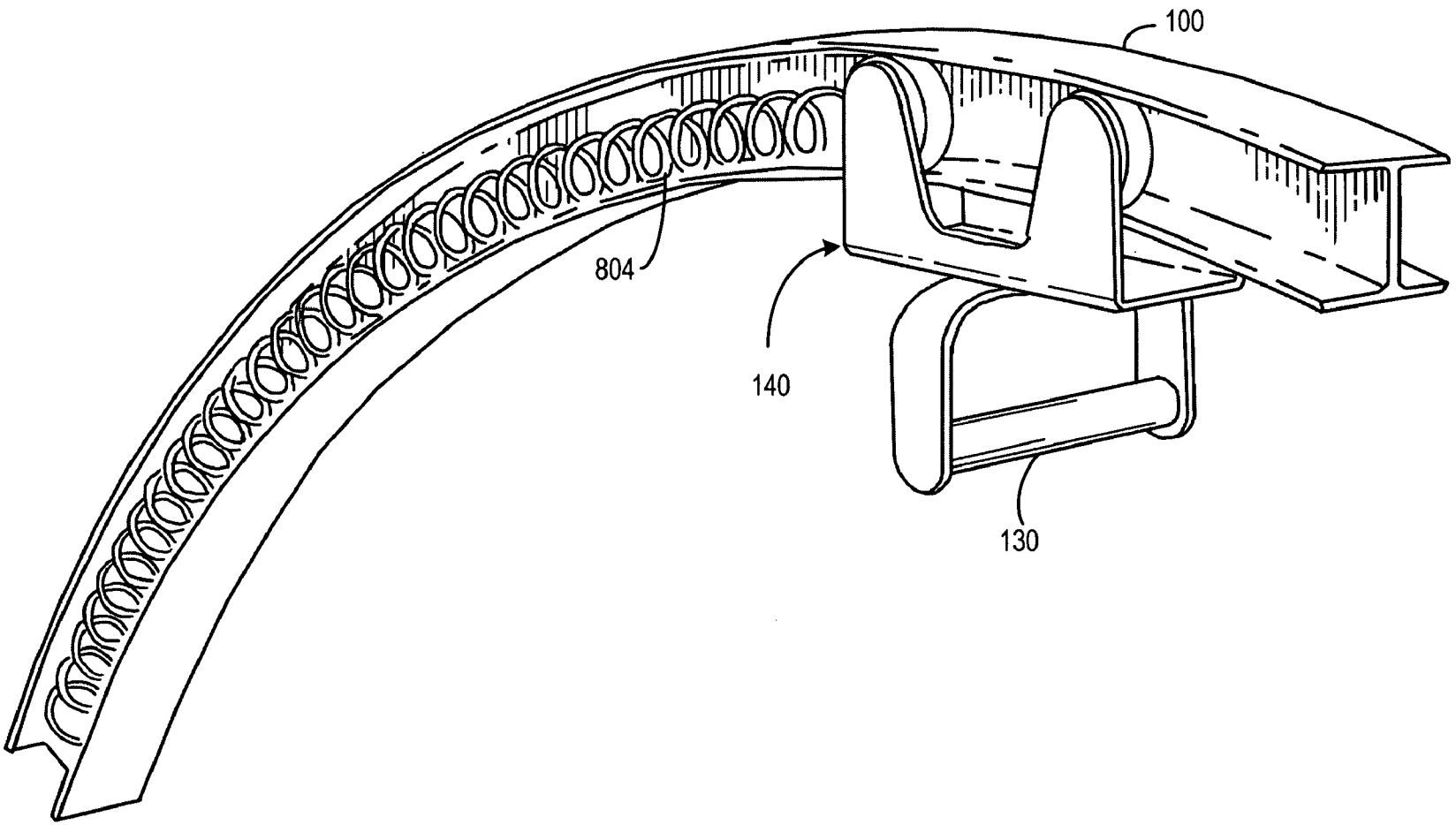
FIG. 8 is an example of the arc-shaped track of the exercise device with an integral resistance spring consistent with certain embodiments of the present invention.

Turning now to FIG. 8, this figure presents an exemplary view of an exercise arc track with an I-shaped cross section 100 with an integral resistance spring 804. In this exemplary embodiment, one end of the resistance spring 804 is attached to the track follower 140, with the distal end of the resistance spring 804 attached to the end of the exercise arc track closest to the point at which the resistance spring 804 is attached to the track follower 140. In an alternative embodiment, the resistance spring 804 may be inserted into a channel of the I-shaped exercise arc track 100 and constrained within the exercise handle at one end of the resistance spring 804 and an end cap (not shown) closing the end of the exercise arc track 100. In this configuration, although the resistance spring 804 is not physically attached to either the exercise handle 130 or the end cap (not shown) cover, the spring is constrained by these elements at each end and may provide resistance to the motion of the exercise handle 132 when the spring is compressed during active motion of the exercise handle 132. In other words, the spring may act as resistance via either stretching or compressing or both during exercise.

In this arrangement, the spring is shown in connection with an I-beam embodiment for ease of illustration, but one skilled in the art will appreciate that constraining a spring may be simpler with a tubular or C-beam type implementation. A similar arrangement may be devised for the C-channel and tubular channel exercise arc tracks or other configurations as will be clear to those skilled in the art upon consideration of the present teachings.

Figure 9:
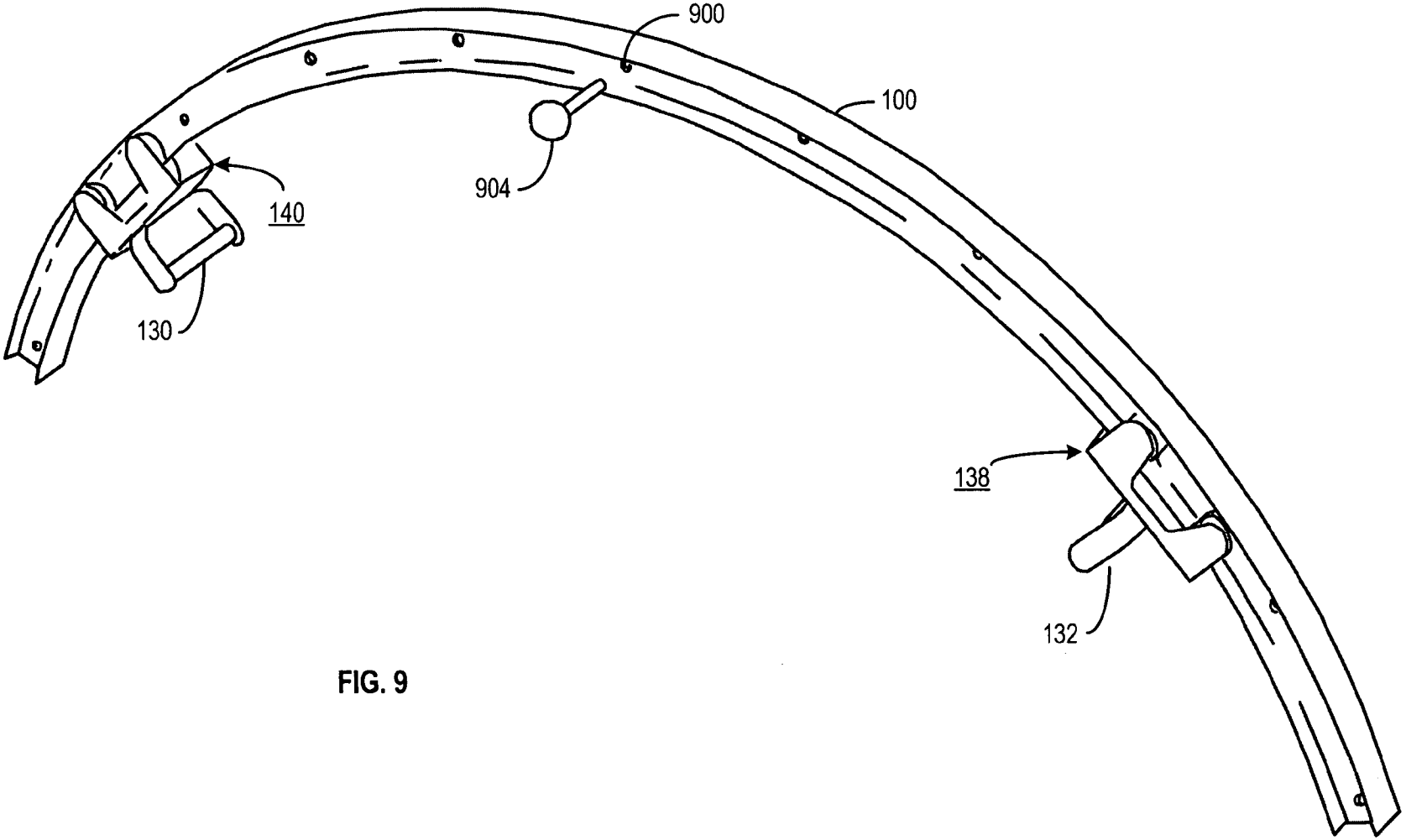
FIG. 9 is an example of the arc-shaped track of the exercise device with motion stops integrated into the track consistent with certain embodiments of the present invention.

Turning now to FIG. 9, this figure presents an exemplary view of an illustrative exercise arc track 100 and exercise handle grips 130 and 132 in a configuration in which a number of motion stops 900 are provided within the exercise arc track 100. The motion stops 900, in this exemplary view, are fabricated by use of a hole drilled or otherwise formed through the exercise arc track 100. An exercise stop 904 such as a pin, bolt or stop block of sufficient diameter can be emplaced securely within the motion stop 900. In one implementation, an oval shaped handle on the non-emplaced end of the exercise stop 904, is used to form a barrier to further motion along the arc of the track by one or both of the track followers 140 and 138. The exercise stop 904 may be used by an individual to ensure that the arc of motion is within certain parameters desired by the user when exercising using the exercise handles. Additionally, multiple stops can be used to create any constraint on movement desired.

In a non-limiting example, a user may desire to exercise using a motion beginning at an upright position and moving through 15 degrees of arc to isolate the motion to a particular set of muscles in the torso. Emplacing an exercise stop 904 at the closest motion stop 900 to either end of a 15 degree arc will allow a user to move only through that arc of motion without having to guess when they have completed the full range of motion and no more. Motion stops 900 may be emplaced in a number of positions along the exercise arc track, such as one at each of a pre-determined degree of arc, or at the center of the arc to facilitate a broad array of possible exercise and therapeutic motions for a user. In the illustrated position, the motion of the handle grip 130 is restricted to the left side of the arc (as shown) while the motion of the handle grip 132 is restricted to the right side of the arc.

Figure 10:
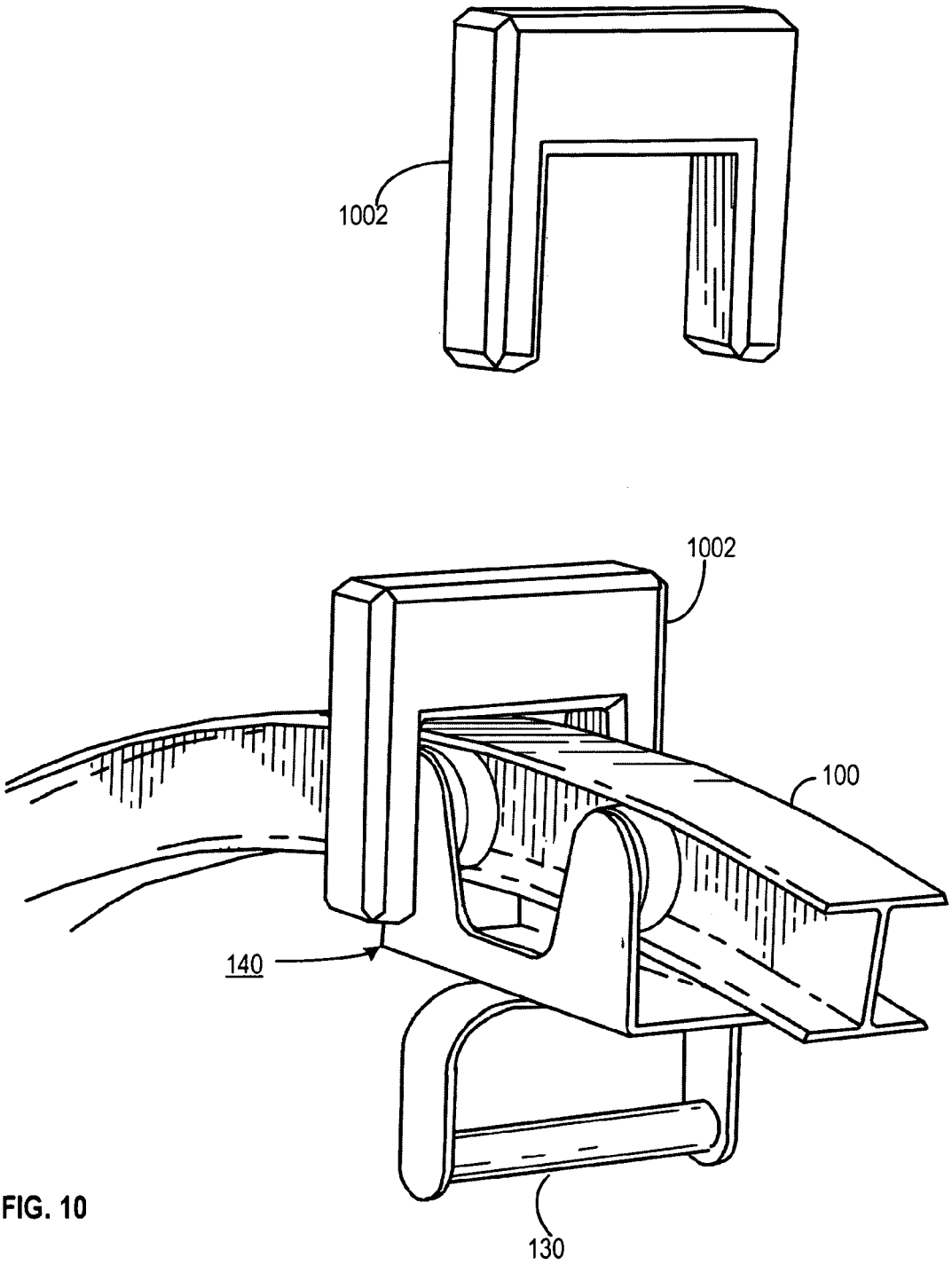
FIG. 10 is an example of weights attachable to the exercise device's routable handles consistent with certain embodiments of the present invention, where the term "routable" is intended to mean that the handle follows the route defined by the arc-shaped track.

Turning now to FIG. 10, this figure presents an exemplary view of an exercise weight 1002 that may be used with the exercise apparatus to provide additional weight resistance to an exercise handle when using the system. By way of non-limiting example an exercise weight 1002 may be configured in an inverted "U" shape of sufficient size to fit over the exercise handle's track follower 140 or 138, and may be secured to the exercise handle through the use of any connection method that will safely and securely maintain the connection of the exercise weight 1002 with the exercise handle throughout any motion or movement of the exercise handle. The exercise weight 1002 is not constrained to an inverted "U" shape, but may be configured in any shape and of any sufficient dimension to fit securely over the top of the track follower and be securely fastened to any part of the exercise handle. In another non-limiting example, more than one exercise weight 1002 may be securely fastened to the exercise handle to provide for greater weight resistance for users who desire a more robust exercise or therapeutic motion session. Additionally, the weight may equivalently be secured to any portion of the track follower or handle in order to provide weight to the handle and track follower assembly.

Figure 11:
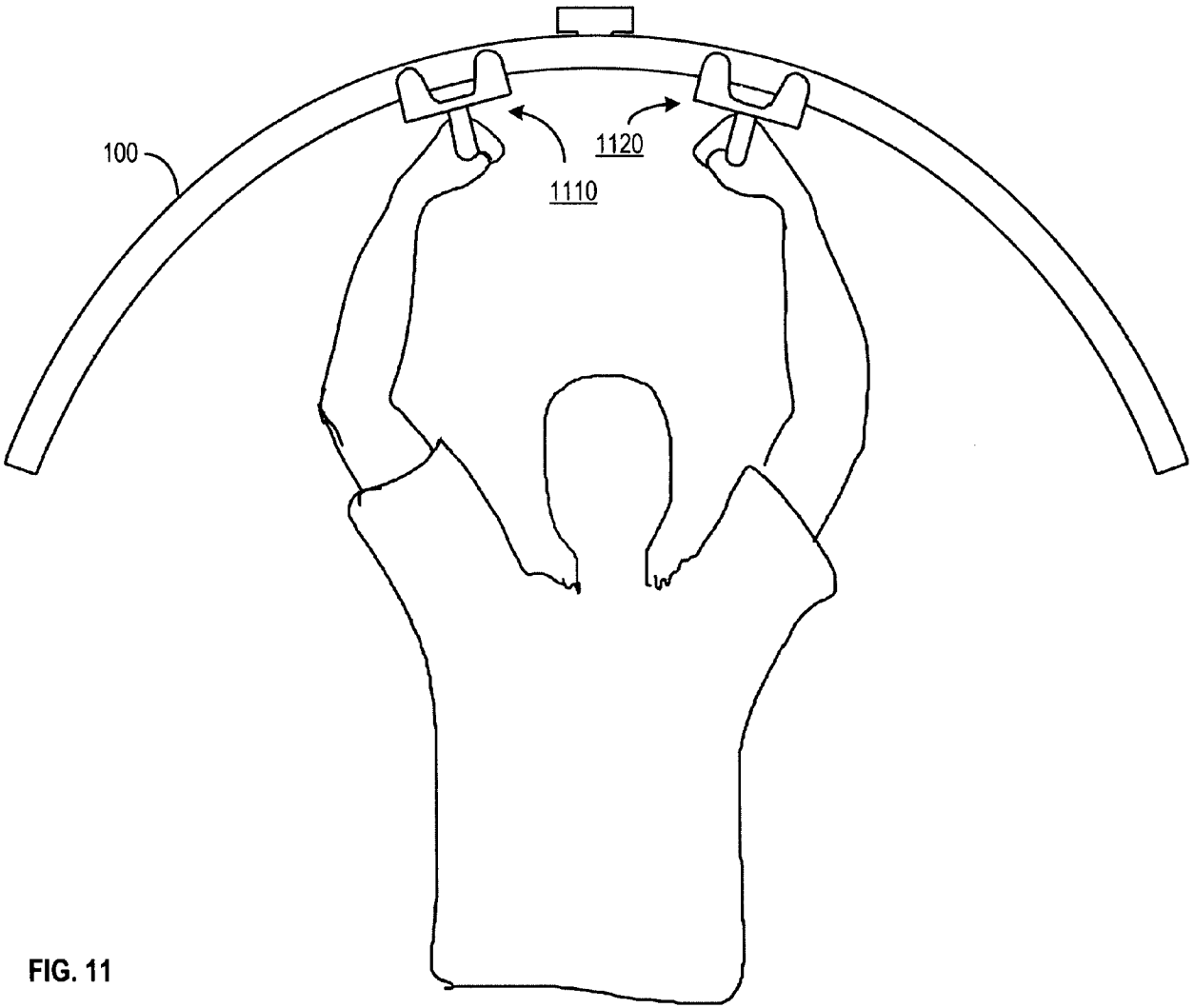
FIG. 11 is an example of the arc-shaped track of the exercise device with an exemplary two-routable-handle grip configuration consistent with certain embodiments of the present invention.

Turning now to FIG. 11, this figure presents an exemplary view of the exercise arc track 100 configured with two exercise handles and their associated track followers in use. In this figure, the handles are depicted generally by 1110 and 1120, but include an operative number of the supporting elements as described previously to permit movement along the track. In a non-limiting example, the exercise arc track 100 may be configured to be mounted on any appropriate mounting system in which the exercise arc track 100 is of sufficient height above the head of a user for the user to comfortably grip the exercise handles 1110 and 1120 when the arms are extended overhead. Continuing the non-limiting example, the user may also configure the exercise handles by coupling or uncoupling the handles, adding or subtracting weight, or establishing appropriate stops to provide the user with the desired range of motion and resistance.

Figure 12A:
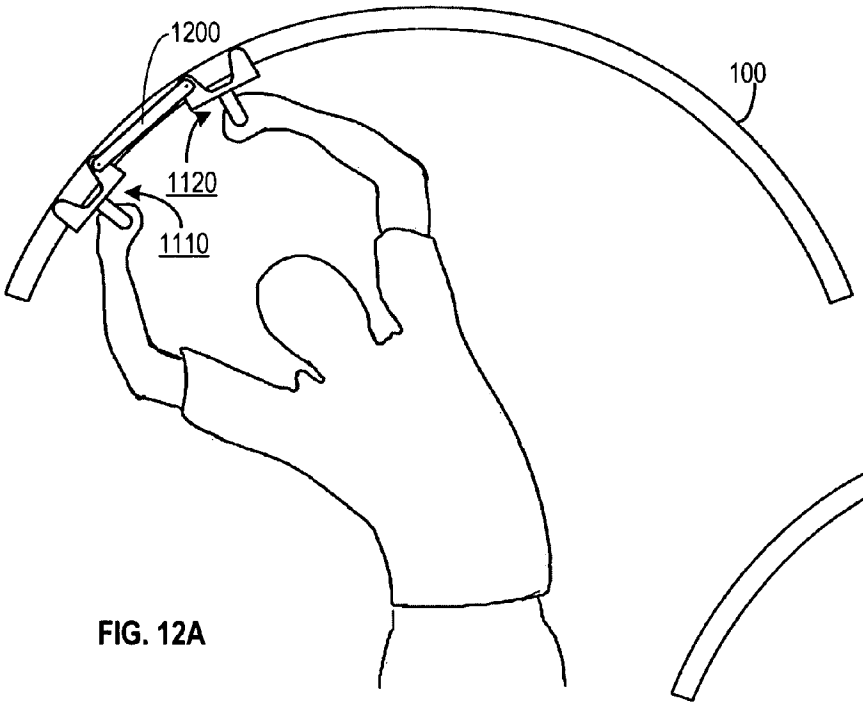
FIG. 12A is an example of the arc-shaped track of the exercise device with an exemplary motion configuration for coupled routable handles consistent with certain embodiments of the present invention.

Turning now to FIG. 12A, this figure presents an exemplary view of range of motion and usage of the apparatus. In a non-limiting example, this view presents the apparatus where the exercise arc track 100 is mounted at a sufficient height above the head of a user for the user to comfortably grip the exercise handles 1110 and 1120 when the arms are extended overhead and in which the exercise handles 1110 and 1120 are coupled together indirectly by coupling the track followers together with a coupler 1200. In this example configuration, a user may begin with an upright position at the center point of the exercise arc track 100 and bend the torso first to one direction (left or right) following the arc of the track until the motion is stopped at a cap enclosing the end of the arc (not shown). The user may then reverse the motion and bend the torso in the opposite direction, passing through the center point of the track and continuing the motion until stopped by the end cap at the other end of the exercise arc track 100. This range of motion provides for an effective exercise of the abdominal oblique muscles of the torso, and the addition of resistance , to the motion of the exercise handles 1110 and 1120 through any of the structural components mention above provides for further strengthening of the muscles used to accomplish this motion.

Figure 12B:
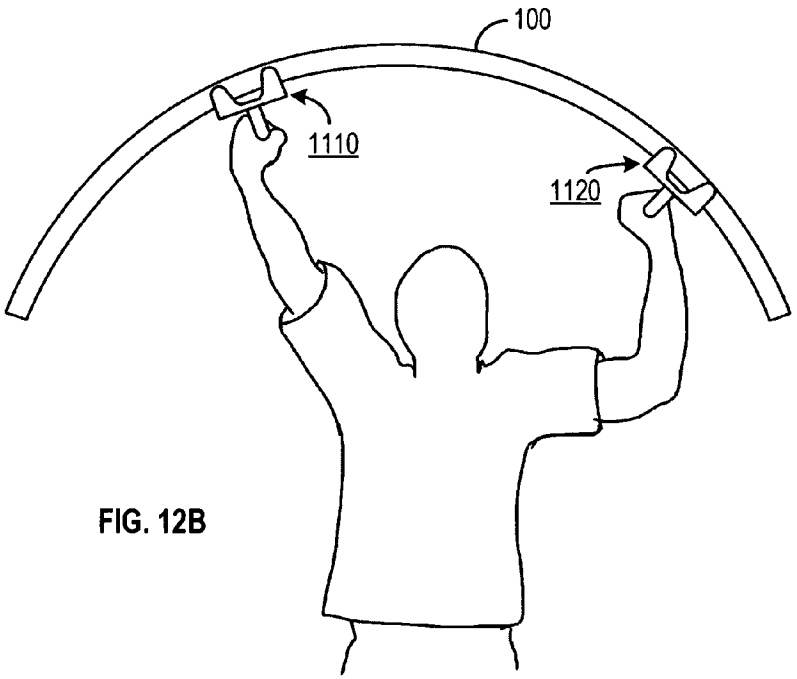
FIG. 12B is an example of the arc-shaped track of the exercise device with an exemplary motion configuration for separate routable handles consistent with certain embodiments of the present invention.

In an alternative exemplary embodiment, FIG. 12B presents the apparatus where the exercise arc track 100 is mounted at a sufficient height above the head of a user for the user to comfortably grip the exercise handle grips 1110 and 1120 when the arms are extended overhead and in which the exercise handles are not coupled together. In this example configuration, the user may move either of the handles independently so as to concentrate upon different muscle groups in the torso, arms, shoulders, and back. The user may, in a non-limiting example, move either arm separately from the other so as to exercise the arms independently, or the user may bend to one side or the other, then move an arm back up the arc of the track so as to perform an action with one arm while the torso remains extended, exercising arm and torso muscles simultaneously. These are merely a few examples of the many configurations and motions that may be accomplished through the appropriate use of the components of the apparatus to achieve the user's motion goals.

Hence, in certain example exercises, a user grasps the handles and moves from side to side using the one or more handles coupled to the one or more track followers to guide the side to side motion flexing at the torso to accomplish an effective workout of the abdominal oblique muscle groups.

Thus, in one example, this document presents an exercise device with an arc shaped track having a concave side that is mounted upon a support structure that supports the arc shaped track at a position in which the concave side of the arc faces downward and in which the arc shaped track can be fixed at a location centered above a user's head to extend to each side of the user. When in use a first and a second track follower may engage the track and move along a length of the track to follow a course defined by the arc shape of the track. A first and a second handle coupled to the first and second track followers respectively are to be gripped by the user's hand, and at least one weight that may be coupled to either handle to provide additional weight to the handle as it is moved along the arc shaped track and generating resistance in the user effort. The first and second handles may be coupled together or move separately and the handle coupled to a track follower guiding the user's hand along the track in the arc shape when the user engages in an exercise motion in which a user's torso bends between a first sideways position and a second sideways position passing through an upright position.

In one implementation, the coupling of the two handles can be a selective coupling such that the handles can be uncoupled. In certain implementations, the arc shaped track may be formed with a generally circular cross section or a generally C-shaped cross section and the track follower may be configured to move within the interior of the arc shaped track. In certain implementations, the arc shaped track may have a motion stop element which is positioned within the arc shaped track so as to stop the motion of the handle at a selected position along the track.

In certain implementations, the track support may have a floor stand that is operable to adjust the height of the arc shaped track above the floor, a wall bracket that is operable to affix the arc shaped track to a wall, or a door frame support bracket for securely affixing the arc shaped track to a doorway where the door frame support positions the arc shaped track in a position normal to a plane passing approximately through the door frame.

In addition, In certain implementations, the arc shaped track may have an I-beam cross section and the track follower may be configured to move along an outside portion of the I-beam. Alternatively, the arc shaped track may comprise a circular cross section beam and the track follower may be configured to move along an outside portion of the beam.

Another exercise apparatus or system for use in performing side-to-side movement may include an arc shaped track having a concave side attached to a support structure that supports the arc shaped track at a position in which the concave side of the arc faces downward and in which the arc shaped track can be fixed at a location centered above a user's head to extend to each side of the user. The apparatus or system may also have at least one track follower that engages the track and is movable along a length of the track to follow a course defined by the arc shape of the track. The track follower may have a handle coupled to the track follower to be gripped by the user's hand. The handle coupled to the track follower may be used to guide the user's hand along the track in the arc shape when the user engages in an exercise motion in which a user's torso bends between a first sideways position and a second sideways position, where the motion may include passing through a full upright position.

In certain implementations, the apparatus or system may have a first and second track follower that may be coupled together and used to guide two hands, where the first and second track followers may be respectively coupled to first and second handles. In certain implementations, each track follower may be combined with at least one weight that is removably coupled to the at least one handle to provide additional weight to the handle as it is moved along the arc shaped track.

In certain implementations, the arc shaped track may be formed with a circular cross section or a C-shaped cross section and the track follower may be configured to move within the interior of the arc shaped track. In addition, in certain implementations, the arc shaped track may have one or more motion stop elements positioned within the arc shaped track so as to stop the motion of a track follower at a selected position along the track.

In certain implementations, the track support for the exercise apparatus or system may have a floor stand that is operable to adjust the height of the arc shaped track above the floor, a wall bracket that is operable to affix the arc shaped track to the wall, or a door frame support bracket for securely affixing the arc shaped track to a doorway where the door frame support positions the arc shaped track in a position normal to a plane passing through the door frame. In addition, in certain implementations, the exercise apparatus or system may have at least one spring that is removably coupled to the at least one handle and configured to provide resistance to the movement of the at least one handle.

In certain implementations, the arc shaped track may have an I-beam cross section and the track follower is configured to move along an outside portion of the I-beam. Alternatively, in certain implementations, the arc shaped track may have a circular cross section beam and the track follower is configured to move along an outside portion of the beam.

An example exercise device with an arc shaped track having a concave side that is mounted upon a support structure that supports the arc shaped track at a position in which the concave side of the arc faces downward and in which the arc shaped track can be fixed at a location centered above a user's head to extend to each side of the user. When in use, a track follower engages the track and moves along a length of the track to follow a course defined by the arc shape of the track. A handle is coupled to the track follower to be gripped by the user's hand to guide the user's side to side bends.

Upon consideration of the above teachings, one skilled in the art will appreciate that many variations in the cross-sectional shape of the arc can be used and springs weights and other enhancements added to facilitate enhancement of a workout. Moreover, many mountings structures can be devised and many arrangements of track followers can be used with either one or more glider surfaces or one or more wheels in a number of configurations. Many other variations will occur to those skilled in the art upon consideration of the present teachings.

While certain illustrative embodiments have been described, it is evident that many alternatives, modifications, permutations and variations will become apparent to those skilled in the art in light of the foregoing description.

What is claimed is:

1. An exercise device, comprising:

an arc shaped track having a concave side;

a support structure that supports the arc shaped track at a position in which the concave side of the arc faces downward and in which the arc shaped track can be fixed at a location centered above a user's head to extend to each side of the user;

a first and a second track follower, each of which engages the track and is movable along a length of the track to follow a course defined by the arc shape of the track;

a first and a second handle coupled to the first and second track followers respectively to be gripped by the user's hand;

at least one weight that is removably coupled to the at least one handle to provide additional weight to the handle as it is moved along the arc shaped track;

where the first and second handles are coupled together; and the first and second handle coupled to the first and second track followers guiding the user's hand along the track in the arc shape when the user engages in an exercise motion in which a user's torso bends between a first sideways position and a second sideways position passing through an upright position.

2. An exercise device as in claim 1, where the coupling of the two handles is a selective coupling such that the handles can be uncoupled.

3. An exercise device as in claim 1, where the arc shaped track is formed with a generally circular cross section that defines an interior within the arc shaped track or a generally C-shaped cross section that defines an interior within the arc shaped track and the first and second track followers are configured to move within the interior of the arc shaped track.

4. An exercise device as in claim 1, where the arc shaped track further comprises a motion stop element which is positioned within the arc shaped track so as to stop the motion of at least one of the first and second handles at a selected position along the track.

5. An exercise device as in claim 1, where the support structure comprises a floor stand that is operable to adjust the height of the arc shaped track above a floor.

6. An exercise device as in claim 1, where the support structure comprises a wall bracket that is operable to affix the arc shaped track to a wall.

7. An exercise device as in claim 1, where the support structure comprises a door frame support bracket for securely affixing the arc shaped track to a doorway.

8. An exercise device as in claim 7, where the door frame support bracket positions the arc shaped track in a position normal to a plane passing approximately through a door frame defining the doorway.

9. An exercise device as in claim 1, where the arc shaped track comprises an I-beam cross section and the first and second track followers are configured to move along an outside portion of the I-beam.

10. An exercise device as in claim 1, where the arc shaped track comprises a circular cross section beam and the first and second track followers are configured to move along an outside portion of the beam.

11. An exercise apparatus, comprising:

an arc shaped track having a concave side attached to a support structure that supports the arc shaped track at a position in which the concave side of the arc faces downward and in which the arc shaped track can be fixed at a location centered above a user's head to extend to each side of the user;

a track follower that engages the track and is movable along a length of the track to follow a course defined by the arc shape of the track;

at least one handle coupled to the track follower to be gripped by the user's hand; the at least one handle coupled to the track follower guiding the user's hand along the track in the arc shape when the user engages in an exercise motion in which a user's torso bends between a first sideways position and a second sideways position, where the motion may include passing through a full upright position; and where the support structure comprises a door frame support bracket for securely affixing the arc shaped track to a doorway and wherein the door frame support bracket positions the arc shaped track in a position normal to a plane passing through a door frame defining the doorway.

12. An exercise apparatus as in claim 11, where:

the at least one handle comprises first and second handles that are coupleable to guide two hands; and where the track follower comprises first and second track followers respectively coupled to the first and second handles.

13. An exercise apparatus as in claim 11, further comprising at least one weight that is removably coupled to the at least one handle to provide additional weight to the handle as it is moved along the arc shaped track.

14. An exercise apparatus as in claim 11, where the arc shaped track is formed with a circular cross section that defines an interior within the arc shaped track or a C-shaped cross section that defines an interior within the arc shaped track and the track follower is configured to move within the interior of the arc shaped track.

15. An exercise apparatus as in claim 11, where the arc shaped track further comprises a motion stop element which is positioned within the arc shaped track so as to stop the motion of the track follower at a selected position along the track.

16. An exercise apparatus as in claim 11, further comprising at least one spring that is removably coupled to the at least one handle and configured to provide resistance to the movement of the at least one handle.

17. An exercise apparatus as in claim 11, where the arc shaped track comprises an I-beam cross section and the track follower is configured to move along an outside portion of the I-beam.

18. An exercise apparatus as in claim 11, where the arc shaped track comprises a circular cross section beam and the track follower is configured to move along an outside portion of the beam.

19. A system to facilitate exercise motion, comprising:

an arc shaped track having a concave side attached to a support structure that supports the arc shaped track at a position in which the concave side of the arc faces downward and in which the arc shaped track can be fixed at a location centered above a user's head to extend to each side of the user;

first and second track followers that engage the track and are movable along a length of the track to follow a course defined by the arc shape of the track;

first and second handles coupled together and to the first and second track followers respectively to be gripped by the user's hands and guiding the user's hands along the track in the arc shape when the user engages in an exercise motion in which a user's torso bends in a side to side motion; and at least one weight that is removably coupled to one or both handles to provide additional weight to either handle as it is moved along the arc shaped track.

20. The system of claim 19, where the first and second track follower handles may be selectively decoupled from one another.

21. The system of claim 19, where the arc shaped track is formed with a circular cross section that defines an interior within the arc shaped track or a C-shaped cross section that defines an interior within the arc shaped track and the first and second track followers are configured to move within the interior of the arc shaped track.

22. The system of claim 19, where the arc shaped track further comprises a motion stop element which is positioned within the arc shaped track so as to stop the motion of either handle at a selected position along the track.

23. The system of claim 19, where the support structure comprises a floor stand that is operable to adjust the height of the arc shaped track above a floor.

24. The system of claim 19, where the support structure comprises a wall bracket that is operable to affix the arc shaped track to a wall.

25. The system of claim 19, where the support structure comprises a door frame support bracket for securely affixing the arc shaped track to a doorway and wherein the door frame support bracket positions the arc shaped track in a position normal to a plane passing through a door frame defining the doorway.

26. The system of claim 19, further comprising at least one spring that is removably coupled to at least one handle and configured to provide resistance to the movement of the at least one handle.

27. The system of claim 19, where the arc shaped track comprises an I-beam cross section and the first and second track followers are configured to move along an outside portion of the I-beam.

28. The system of claim 19, where the arc shaped track comprises a circular cross section beam and the first and second track followers are configured to move along an outside portion of the beam.

29. A system to facilitate exercise motion, comprising:

an arc shaped track having a concave side attached to a support structure that supports the arc shaped track at a position in which the concave side of the arc faces downward and in which the arc shaped track can be fixed at a location centered above a user's head to extend to each side of the user;

where the support structure comprises a floor stand that is operable to adjust the height of the arc shaped track above a floor;

first and second track followers that engage the track and are movable along a length of the track to follow a course defined by the arc shape of the track; and first and second handles coupled together and to the first and second track followers respectively to be gripped by the user's hands and guiding the user's hands along the track in the arc shape when the user engages in an exercise motion in which a user's torso bends in a side to side motion.

30. The system of claim 29, where the first and second track follower handles may be selectively decoupled from one another.

31. A system to facilitate exercise motion, comprising:

an arc shaped track having a concave side attached to a support structure that supports the arc shaped track at a position in which the concave side of the arc faces downward and in which the arc shaped track can be fixed at a location centered above a user's head to extend to each side of the user;

where the support structure comprises a wall bracket that is operable to affix the arc shaped track to a wall;

first and second track followers that engage the track and are movable along a length of the track to follow a course defined by the arc shape of the track; and first and second handles coupled together and to the first and second track followers respectively to be gripped by the user's hands and guiding the user's hands along the track in the arc shape when the user engages in an exercise motion in which a user's torso bends in a side to side motion.

32. The system of claim 31, where the first and second track follower handles may be selectively decoupled from one another.

33. A system to facilitate exercise motion, comprising:

an arc shaped track having a concave side attached to a support structure that supports the arc shaped track at a position in which the concave side of the arc faces downward and in which the arc shaped track can be fixed at a location centered above a user's head to extend to each side of the user;

where the support structure comprises a door frame support bracket for securely affixing the arc shaped track to a doorway and wherein the door frame support bracket positions the arc shaped track in a position normal to a plane passing through a door frame defining the doorway;

first and second track followers that engage the track and are movable along a length of the track to follow a course defined by the arc shape of the track; and first and second handles coupled together and to the first and second track followers respectively to be gripped by the user's hands and guiding the user's hands along the track in the arc shape when the user engages in an exercise motion in which a user's torso bends in a side to side motion.

34. The system of claim 33, where the first and second track follower handles may be selectively decoupled from one another.

* * * * *